US006814708B1

(12) United States Patent
Jennings

(10) Patent No.: US 6,814,708 B1
(45) Date of Patent: Nov. 9, 2004

(54) BODY STRETCHING APPARATUS AND METHOD

(76) Inventor: Ralph Ernest Jennings, 703 Discovery Bay, New Bern, NC (US) 28562

( * ) Notice: Subject to any disclaimer, the term of this patent is extended or adjusted under 35 U.S.C. 154(b) by 289 days.

(21) Appl. No.: 10/064,885

(22) Filed: Aug. 27, 2002

(51) Int. Cl.[7] ..... A61H 1/02

(52) U.S. Cl. ..... 601/24; 482/102; 482/145; 482/907; 602/32; 606/242

(58) Field of Search ..... 482/99–103, 140, 482/142, 145, 907; 601/24; 602/32; 606/240–243

(56) References Cited

U.S. PATENT DOCUMENTS

| | | | | | |
|---|---|---|---|---|---|
| 620,318 | A | * | 2/1899 | Havner | 606/241 |
| 896,114 | A | * | 8/1908 | Jacobson | 606/241 |
| 1,804,441 | A | * | 5/1931 | Silva | 606/244 |
| 2,690,175 | A | | 9/1954 | Daughtry | |
| 2,774,349 | A | | 12/1956 | Judovich | |
| 4,114,611 | A | * | 9/1978 | Lyle et al. | 606/241 |
| 4,627,422 | A | | 12/1986 | Bates | |
| 4,700,696 | A | * | 10/1987 | Schoffstall | 606/244 |
| 5,449,336 | A | | 9/1995 | Sabel | |
| 5,529,560 | A | | 6/1996 | Davies | |
| 5,626,547 | A | | 5/1997 | Davies | |
| 5,938,573 | A | | 8/1999 | Davies | |
| 5,957,955 | A | | 9/1999 | Thomas | |
| 6,302,859 | B1 | * | 10/2001 | Cushman | 602/32 |

* cited by examiner

*Primary Examiner*—Nicholas D. Lucchesi
*Assistant Examiner*—Victor Hwang
(74) *Attorney, Agent, or Firm*—John F. Bohland

(57) ABSTRACT

The present invention provides an apparatus and a method for stretching a human body in a substantially horizontal attitude. The apparatus places the body under a predetermined tensile load, uniformly distributed over the length of the body. The apparatus applies the loading force gradually in order avoid shock loads on the body. The apparatus may be operated easily and safely by the user, without assistance from another person.

16 Claims, 8 Drawing Sheets

BODY STRETCHING APPARATUS AND METHOD

BACKGROUND OF INVENTION

The present invention relates to exercise devices. More particularly, the present invention relates to exercise devices for stretching a human body.

Stretching has been recognized for many years as an important part of exercise programs for general fitness and for physical therapy. Stretching before and after an exercise program increases flexibility and reduces injuries. In physical therapy, stretching is used to recover flexibility lost through injury or disease.

U.S. Pat. No. 5,957,955, incorporated herein by reference, describes a back stretching system that uses the gravitational forces acting on a human body to stretch the lumbar region of the spine and thereby alleviate the conditions of herniated and bulging discs. The machine, as described, focuses on the lumbar region and does not provide a uniform stretching load over the body. It also does not provide any means for adjusting the load.

U.S. Pat. Nos. 5,938,573, 5,626,547, and 5,529,560, all incorporated herein by reference, provide stretch therapy apparatuses for physical fitness, rehabilitation, and medical treatment. However, none of the systems described are capable of placing a uniform, selectable, longitudinal load on a human body.

U.S. Pat. No. 5,449,336, incorporated herein by reference, describes a stretching machine having a framework with a number of restraint points for fixing various points on a user's body and a motor-driven tractive line for applying a load to the user's body. However, there does not appear to be means for applying a fixed load having a predetermined value uniformly to a human body.

U.S. Pat. No. 4,627,422, incorporated herein by reference, describes a variable traction apparatus that uses gravitational forces on a user's body, supplemented by added weights, to provide a controlled amount of tractive force. As with all techniques using gravitational forces on an inclined or vertical body, the stretching force varies over the body with the higher body parts supporting a greater portion of the body weight than the lower body parts.

U.S. Pat. No. 2,774,349, incorporated herein by reference, describes a lumbar traction apparatus specifically designed to apply a tractive force to the lumbar region of patients with lower back problems. The apparatus does not stretch the entire body and does not provide the user with control over the application of the load.

U.S. Pat. No. 2,690,175, incorporated herein by reference, provides a traction table for patients in need of such treatment but does not provide a safe stretch exerciser that can be operated by the user.

SUMMARY OF INVENTION

It is an object of the present invention to provide a human body stretching apparatus that applies a uniform longitudinal stretching force to substantially the entire body.

It is a further object of the present invention to provide a body stretching apparatus that applies the load gradually, thereby avoiding the risk of injury due to shock loading.

It is also an object of the present invention to provide a body stretching apparatus wherein the magnitude of the loading force is selectable and stable.

It is a further object of the present invention to provide a body stretching apparatus that may be operated easily and safely by the user without assistance from another person.

It is also an object of the present invention to provide a body stretching method that stretches and tones the entire body at one time, thereby reducing the time required to maintain fitness.

DETAILED DESCRIPTION

Figure 1:
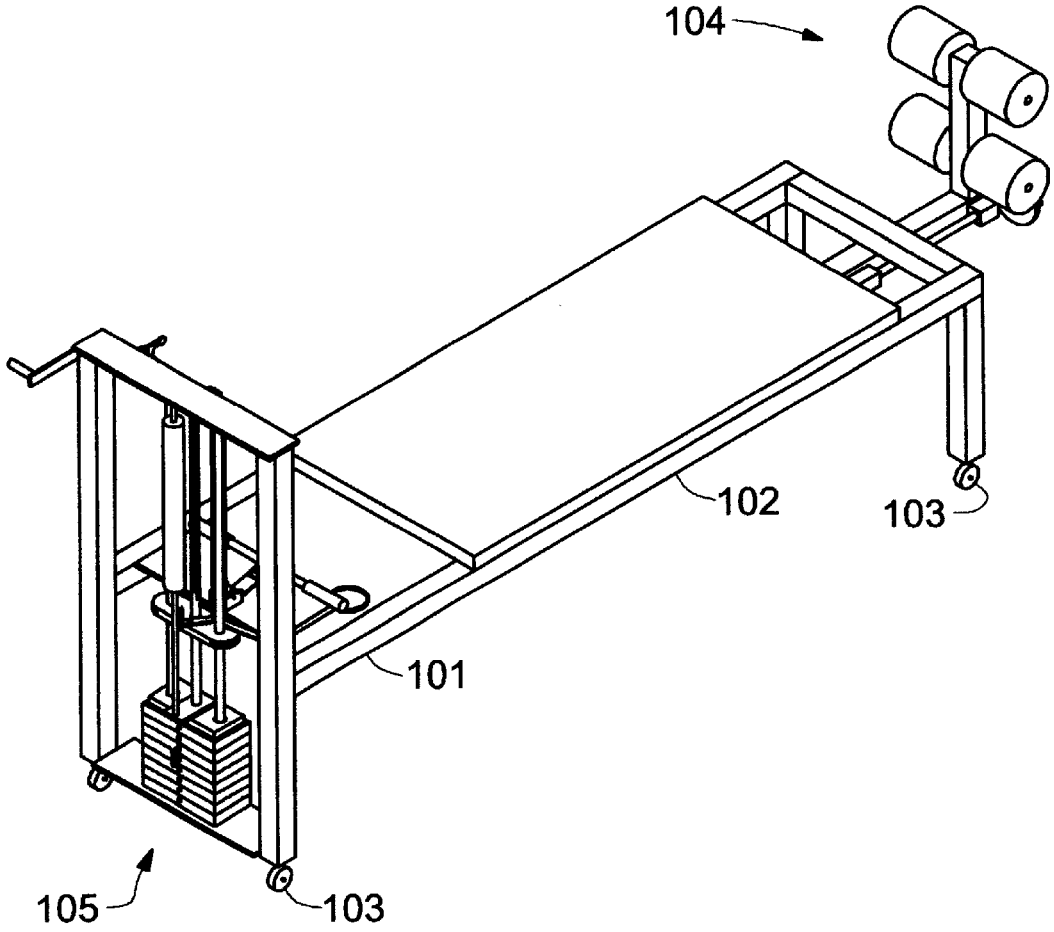
FIG. 1 is a perspective view of a preferred embodiment of a body stretching apparatus according to the present invention.

FIG. 1 shows a preferred embodiment of a body stretching apparatus according to the present invention. It includes means for supporting a human body in a substantially horizontal position while allowing some degree of horizontal movement in order to equalize tensile forces on the body. A support frame (101) provides a substantially horizontal support for a padded roller table (102). The padded roller table is designed to support a supine human body while allowing longitudinal and lateral motion. The freedom of motion of the table allows the stretching load to be uniformly distributed on the user of the apparatus. The table is lightly padded for comfort. The support frame (101) is mounted on casters (103), allowing the apparatus to be easily moved. A foot restraint assembly (104) provides a means for restraining movement at one end of a body, and a weight stack assembly (105) provides a means for applying a stretching force to the other end.

Figure 2:
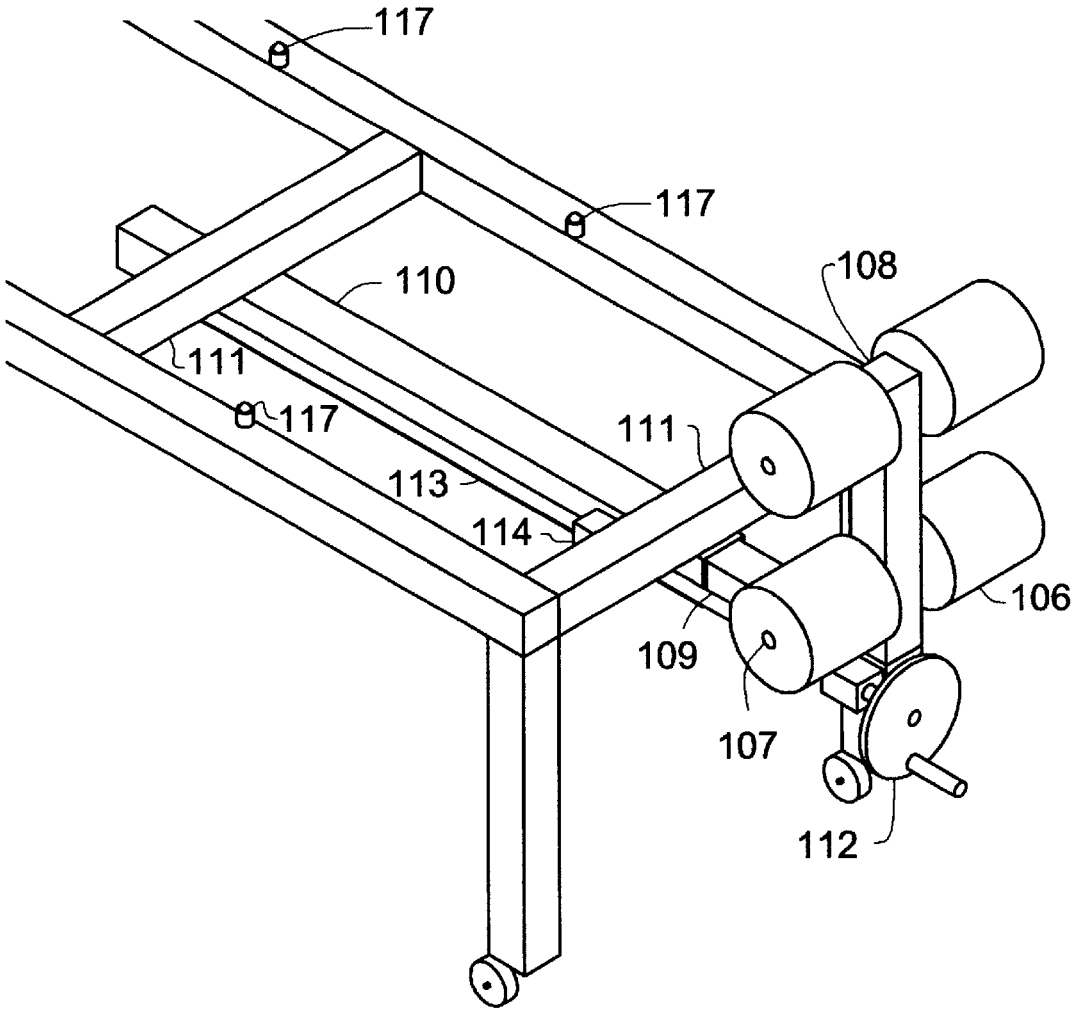
FIG. 2 is an enlarged view of the adjustable foot restraint assembly.
Figure 3:
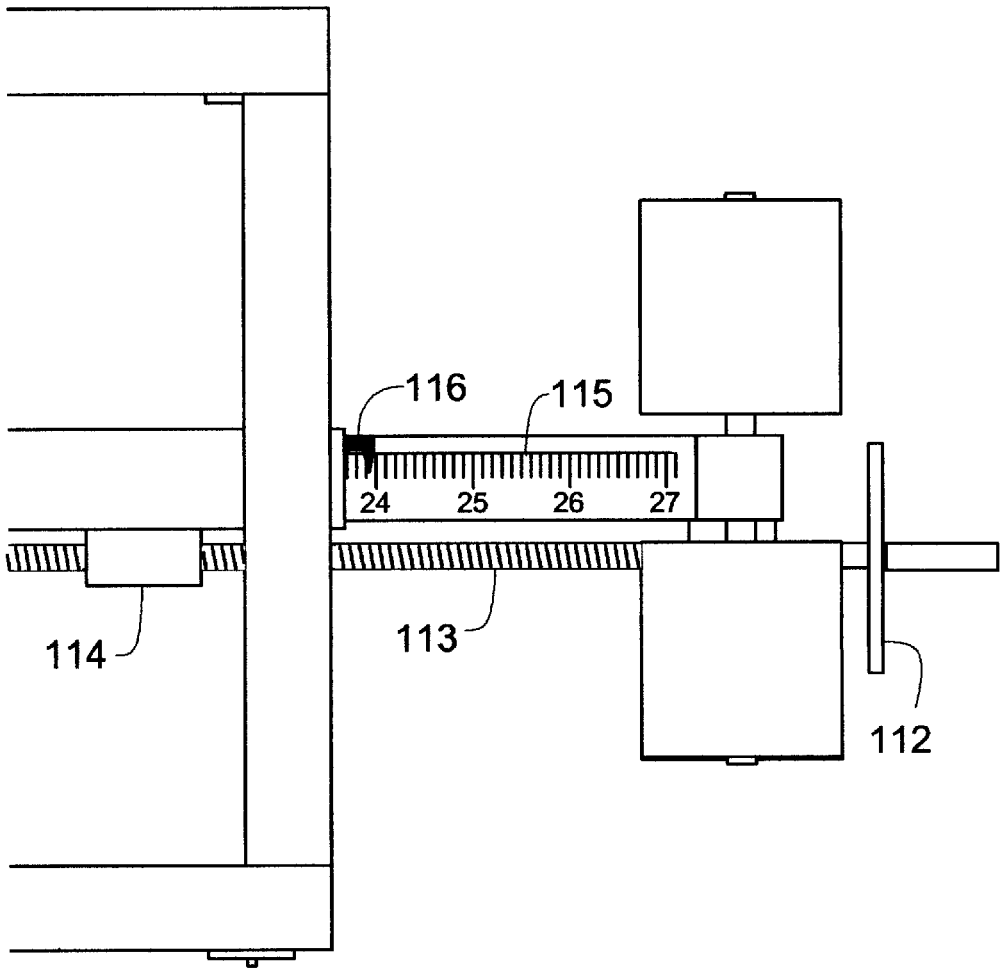
FIG. 3 shows details of the foot restraint positioning mechanism.

The padded roller table has been removed in FIG. 2 to show the complete foot restraint assembly. It includes four padded cylinders (106) that contact the user's feet and prevent movement toward the weight stack assembly. The padded cylinders are mounted on support shafts (107), and the support shafts are in turn attached to a vertical support member (108). The bottom end of the vertical support member is attached to a horizontal support member (109) that slides under the support frame in a tubular guide (110) attached to cross-members (111) on the support frame. The position of the foot restraint assembly is changed using a crank wheel (112) and lead screw (113) mounted at the bottom end of the vertical support member. The lead screw is engaged with a nut (114) that is fixed to the tubular guide. Rotation of the crank wheel is used to move the padded cylinders to the correct distance from the weight stack to accommodate the body length of the user. Details of the foot restraint positioning mechanism are shown in FIG. 3. A scale (115) is attached to the horizontal support member and moves with the foot restraint assembly. An index (116) is mounted on the tubular guide over the scale whereby a reproducible measure of the position of the restraint assembly may be read from the scale.

The roller table support rollers (117), which are normally hidden by the roller table, are visible in FIG. 2. The table is supported by a plurality of rollers, preferably four to twelve rollers. More preferably, six to eight rollers are used to support the table. The rollers are mounted on the frame in a manner that allows a small amount of transverse motion and a greater amount of longitudinal motion. Preferably, the transverse motion is limited to between zero to two inches. In the most preferred embodiment, the transverse motion of the roller table is limited to 0.5 to 1.5 inches. The longitudinal motion is preferably limited to six to eighteen inches. Other means for supporting a human body in a substantially horizontal position while allowing some horizontal movement, such as a plurality of moveable padded sections or multiple roller balls or cylinders, are encompassed by the present invention, as claimed.

Figure 4:
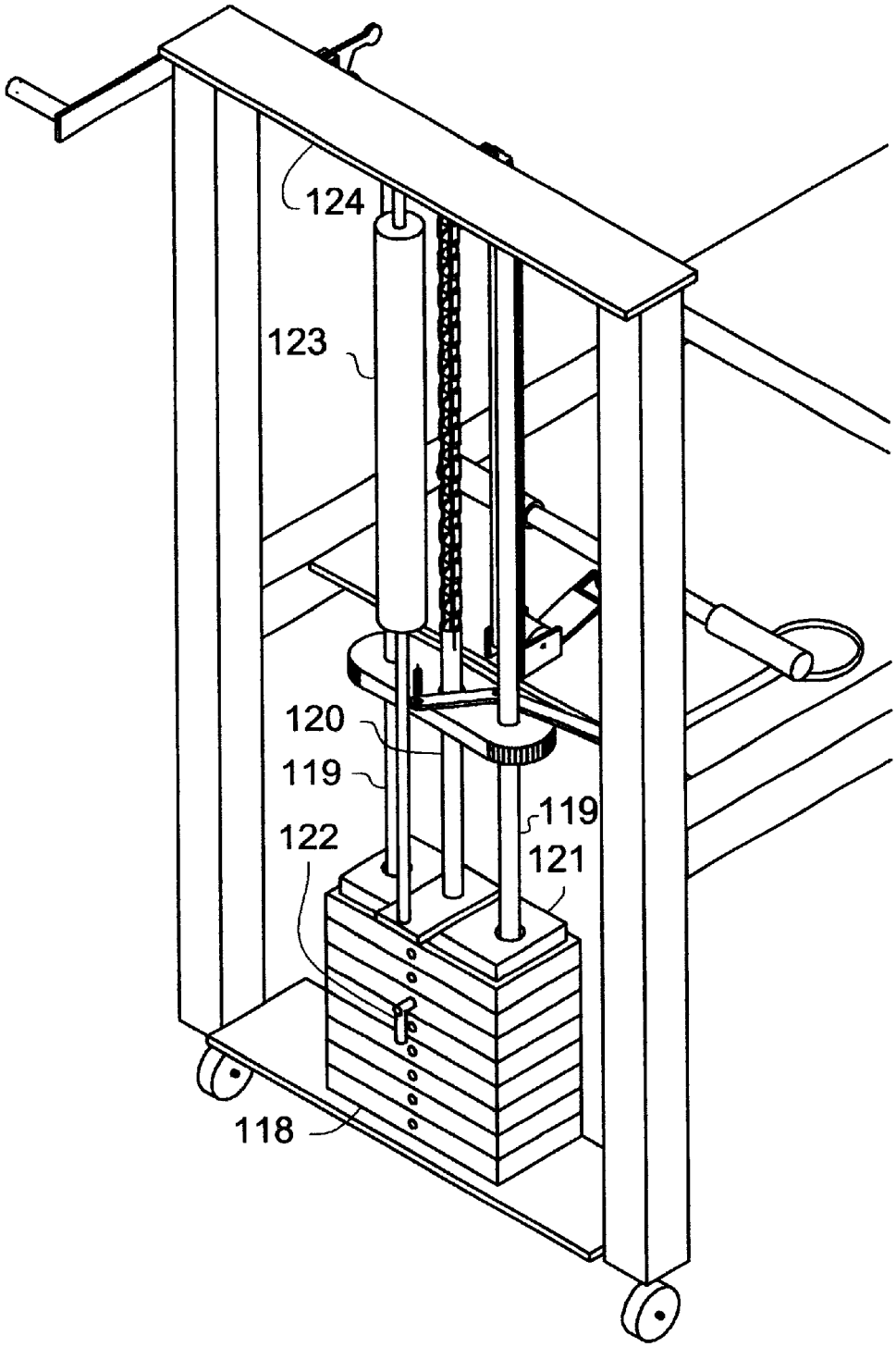
FIG. 4 is an enlarged view of the weight stack.

An enlarged view of the weight stack assembly is shown in FIG. 4. The weight stack components include cast iron weights (118), guide rods (119), a stack lifting rod (120), a top plate (121), and a selector pin (122). The guide rods, which are fixed in position, restrict the movement of the weights to a straight, vertical path, thereby providing smooth and safe operation. The top plate is fixed to the stack lifting rod and stabilizes the weights below. The selector pin may be inserted through any particular weight desired and through a corresponding aperture in the stack lifting rod. When the weight stack is raised by applying tension to the the stack lifting rod, all the weights at and above the selector pin are raised with the stack lifting rod and top plate.

Means for preventing shock loading is provided in the preferred embodiment by a velocity damper (123) connected between the top plate and a horizontal member (124) on the support frame. The velocity damper has little affect on the motion of the weight stack in the upward direction but limits the velocity in the downward direction to a safe level. Velocity dampers such as this are well known and are readily available. Typically, a commercially available velocity damper consists of a hydraulic cylinder and a piston with an aperture. The restricted fluid flow through the aperture limits the speed of the piston. The velocity damper in the present invention incorporates a flapper valve or other type of check valve to allow relatively unrestricted fluid flow when raising the weight stack.

Although the weight stack described above is a preferred means for applying a stretching force to a human body according to the present invention, other means may be used and are within the scope of the appended claims. Springs, pneumatic cylinders, hydraulic cylinders, and electric motors are examples of other means for providing a stretching force.

Figure 5:
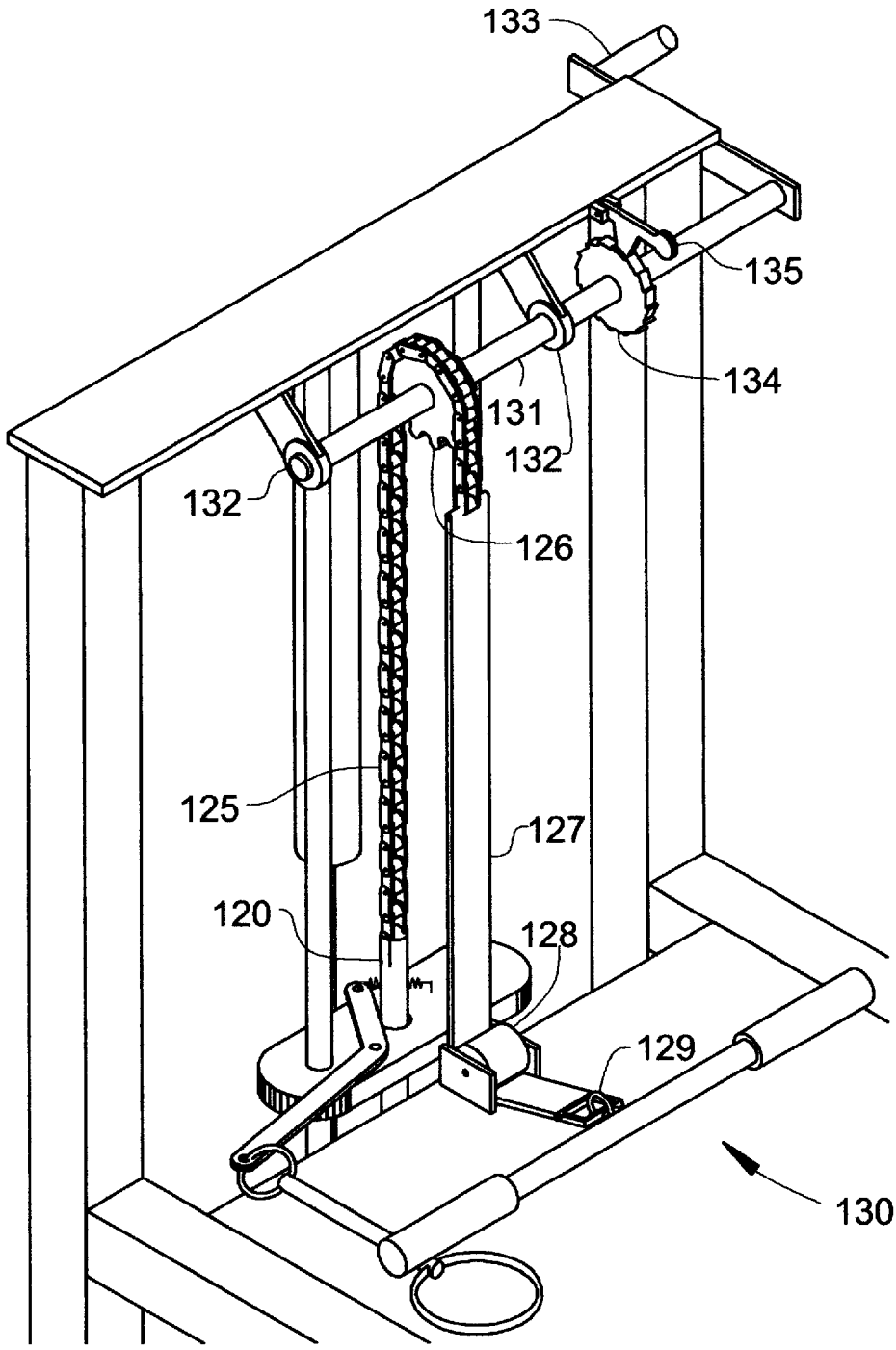
FIG. 5 is an enlarged view of the stack lifting mechanism.

FIG. 5 shows the stack lifting chain (125) attached to the stack lifting rod (120) and running over a stack lifting sprocket wheel (126). The other end of the stack lifting chain is connected to a loading strap (127) that runs over a pulley (128) and terminates in a connector (129). The connector is attached to a hand grip loading bar (130). The stack lifting sprocket wheel is mounted on a stack lifting shaft (131). The stack lifting shaft is supported by bearings (132). A stack lifting crank handle (133) is attached to the stack lifting shaft and provides sufficient mechanical advantage to allow the user of the apparatus to easily lift the weight stack to the raised position. A ratchet wheel (134) is mounted on the stack lifting shaft and is engageable with a locking pawl (135). The ratchet wheel and pawl prevent the weight stack from descending unintentionally while the user is lifting the stack.

Figure 6:
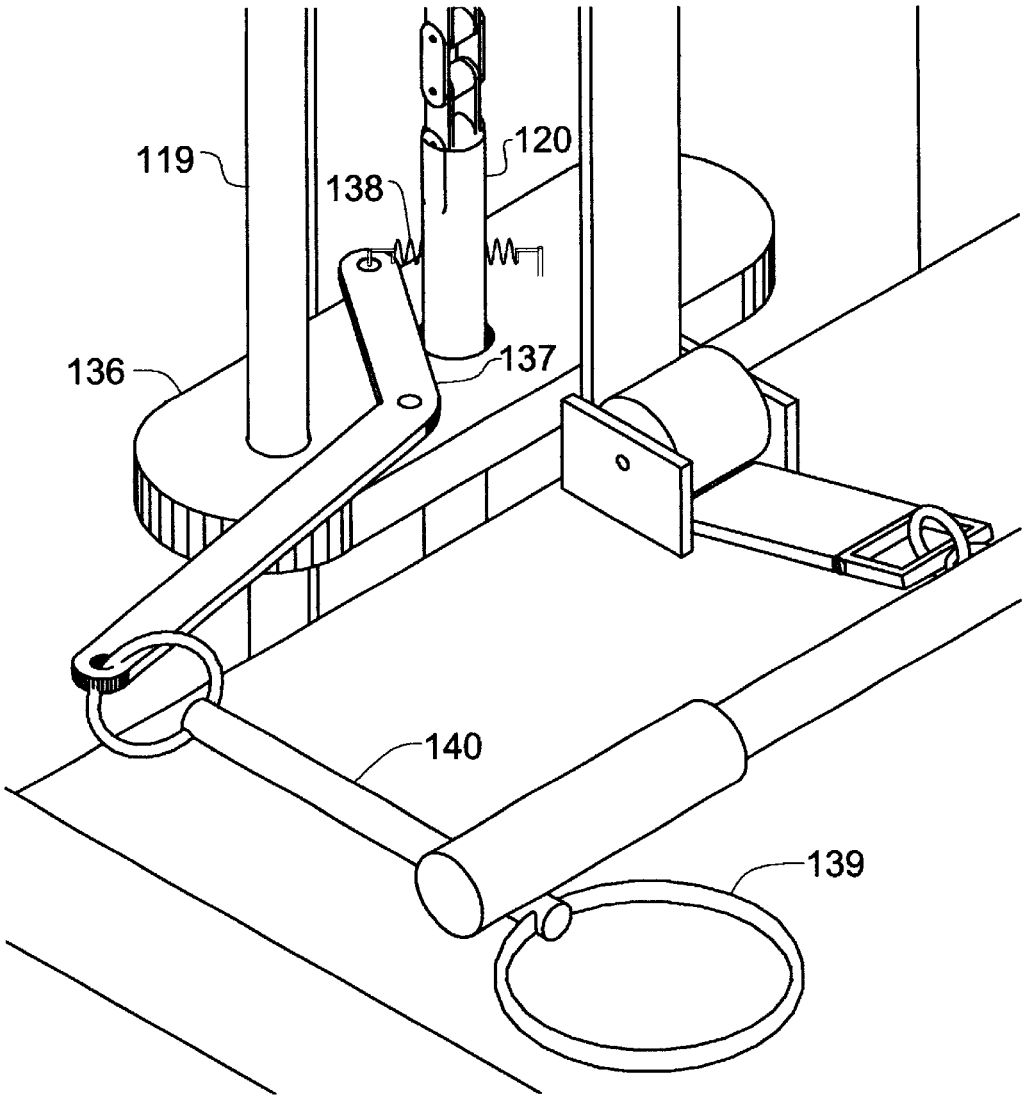
FIG. 6 is an enlarged view of the weight stack locking mechanism in the unlocked position.

FIG. 6 is an enlarged view of the weight stack locking mechanism in the unlocked position. The stack lifting rod (120) passes freely through a locking assembly support plate (136) that is rigidly attached to the guide rods (119). A release lever (137) is held against the lifting rod by spring (138). Release handle (139) is attached to the release lever by connecting means (140). The connecting means may be either a rigid rod or flexible wire or cord.

Figure 7:
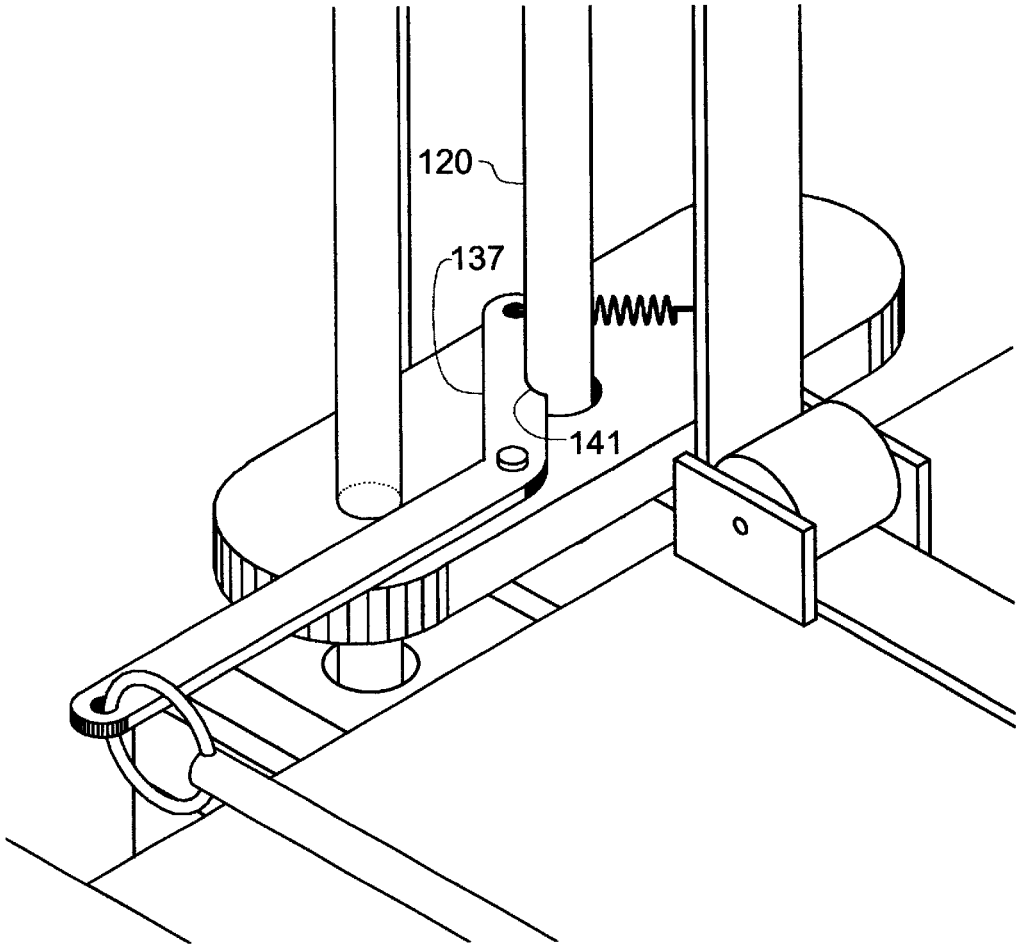
FIG. 7 is an enlarged view of the weight stack locking mechanism in the locked position.

FIG. 7 shows the weight stack locking mechanism in the locked position. The stack lifting rod (120), with the selected portion of the weight stack, is at the top of its travel range and the release lever (137) is engaged with a locking slot (141) in the stack lifting rod.

Figure 8:
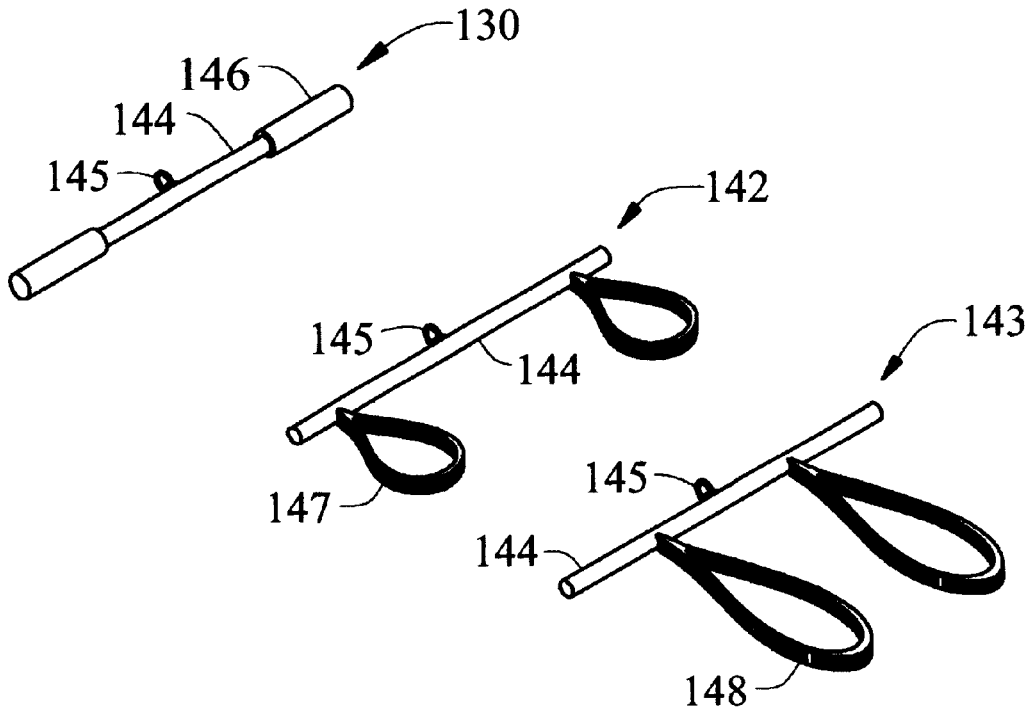
FIG. 8 shows various devices used to apply a stretching load to different parts of the body.

The various means for applying a stretching load to a user's body are shown in FIG. 8. they include a hand grip loading bar (130), a wrist loading bar (142), and a shoulder loading bar (143). Each of these accessories utilizes a rigid bar (144) with an eye (145) for attaching to the loading strap connector. The grip loading bar has hand grips (146) while the wrist loading bar has straps (147) through which the user may place his hands. The shoulder loading bar has large straps (148) through which the user may insert his arms and thereby apply the stretching load under his shoulders.

When using the above preferred embodiment of the body stretching apparatus according to the present invention, the user first selects a means for applying a stretching load and attaches it to the connector (129). He then sets the position of the foot restraint pads using crank wheel (112) and scale (115). The numerical value of the setting needs to be experimentally determined beforehand. The user then selects the desired loading force by inserting selector pin (122) through the desired weight. The locking pawl (135) is lowered so that it engages the ratchet wheel (134), and the stack lifting crank handle (133) is used to lift the stack to the fully raised position. The release lever (137) engages the stack lifting rod (120) to hold the weight stack in the fully raised position. The locking pawl (135) is then raised so that it does not engage the ratchet wheel (134). The user then assumes a supine position on the roller table (102) and engages his feet in the foot restraint pads. He pulls the release handle (139) and grasps the hand grip loading bar (130). The stretching load is gradually applied to the user's body at a rate determined by the selected weight and the size of the aperture in the velocity damper. At the end of the desired stretching time, the user disengages himself from either the means for applying the stretching force or the foot restraints.

The present invention also provides a method for stretching a human body in order to contribute to health or fitness. The body to be stretched is placed in a substantially horizontal position and one end of the body is restrained while a longitudinal stretching force is applied to the other end. The stretching force is uniform over the length of the body between the point of application of the stretching force and the restraint. The stretching force, with a magnitude between ten pounds and two hundred pounds is maintained on the body for a desired stretching time of between ten seconds and one hour. In a first preferred embodiment, the stretching force has a magnitude between one hundred and two hundred pounds and the desired stretching time is between ten seconds and ten minutes. In a second preferred embodiment, the stretching force has a magnitude between ten and one hundred pounds and the stretching time is between one minute and one hour. In one aspect the longitudinal stretching force places the body in tension between the up-stretched hands to the feet. In another aspect, the tensile force is applied between the shoulders and the feet.

What is claimed is:

1. An apparatus for stretching a human body having first and second ends, the apparatus comprising:

(a) means for supporting the human body in a substantially horizontal position;

(b) means for restraining movement at the first end of the human body;

(c) means for applying a longitudinal stretching force to the second end of the human body wherein said stretching force has a selectable, predetermined magnitude, wherein said means for applying a longitudinal stretching force to the second end of the body comprises a weight stack, means for raising a predetermined portion of said weight stack, means for converting a vertical force of said predetermined portion of said weight stack to a horizontal force, and means for applying said horizontal force to the second end of the human body;

(d) means for preventing shock loads on the human body comprising a velocity damper; and (e) means for selectively locking said predetermined portion of said weight stack in a raised position.

2. The apparatus of claim 1 wherein said means for supporting the human body comprises a platform slidably mounted to a structural frame.

3. The apparatus of claim 2 wherein the means for restraining movement at said first end of the human body comprises a set of foot restraints and a lead screw whereby the position of said set of foot restraints is adjustable using said lead screw.

4. The apparatus of claim 1 wherein the means for restraining movement at said first end of the human body comprises a set of foot restraints and a lead screw whereby the position of said set of foot restraints is adjustable using said lead screw.

5. The apparatus of claim 1, wherein said means for selectively locking the predetermined portion of said weight stack in a raised position comprises a locking assembly support plate selectively engaging a stack lifting rod.

6. The apparatus of claim 5, wherein said locking assembly support plate includes a biased release lever operatively engageable with a slot on the stack lifting rod.

7. The apparatus of claim 6 further comprises a release handle connected to said release lever.

8. The apparatus of claim 6, wherein said release lever is biased by a spring to engage said stack lifting rod.

9. The apparatus of claim 5, wherein said locking assembly support plate is rigidly fixed to a guide rod of said weight stack.

10. The apparatus of claim 1, wherein said means for selectively locking said predetermined portion of said weight stack in a raised position comprises a locking pawl selectively engaging a ratchet wheel.

11. The apparatus of claim 10, wherein said ratchet wheel is mounted on a rotatable stack lifting shaft; and a stack lifting sprocket wheel mounted to said stack lifting shaft and having a stack lifting chain running over said stack lifting sprocket wheel and being attached to a lifting rod of said weight stack.

12. The apparatus of claim 1, wherein said means for applying said horizontal force to the second end of the human body comprises a hand grip loading bar.

13. The apparatus of claim 1, wherein said means for applying said horizontal force to the second end of the human body comprises a wrist loading bar and wrist straps.

14. The apparatus of claim 1, wherein said means for applying said horizontal force to the second end of the human body comprises a shoulder loading bar and shoulder straps.

15. The apparatus of claim 1, wherein said velocity damper comprises a hydraulic cylinder.

16. The apparatus of claim 15, wherein said hydraulic cylinder is secured between a top plate of said weight stack and a support frame of the apparatus.

* * * * *